US007560864B2

(12) United States Patent
Song

(10) Patent No.: US 7,560,864 B2
(45) Date of Patent: Jul. 14, 2009

(54) PLASMA DISPLAY PANEL HAVING SLANTED ELECTRODES EMBEDDED IN DIELECTRIC PARTITION WALLS

(75) Inventor: Jung-Suk Song, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 508 days.

(21) Appl. No.: 11/209,326

(22) Filed: Aug. 23, 2005

(65) Prior Publication Data

US 2006/0043893 A1 Mar. 2, 2006

(30) Foreign Application Priority Data

Aug. 31, 2004 (KR) ..... 10-2004-0069150

(51) Int. Cl.
*H01J 17/49* (2006.01)

(52) U.S. Cl. ..... 313/582; 313/584; 313/586; 313/587

(58) Field of Classification Search ..... 313/582–587
See application file for complete search history.

(56) References Cited

U.S. PATENT DOCUMENTS

| | | | | |
|---|---|---|---|---|
| 3,811,061 | A | 5/1974 | Nakayama et al. | |
| 6,252,353 | B1 * | 6/2001 | Ha et al. | 313/582 |
| 7,067,979 | B2 * | 6/2006 | Sakamoto | 313/584 |
| 2005/0093444 | A1 * | 5/2005 | Woo et al. | 313/582 |

FOREIGN PATENT DOCUMENTS

| | | | |
|---|---|---|---|
| JP | 46-81407 | | 10/1971 |
| JP | 48-47271 | | 7/1973 |
| JP | 57212743 | A * | 12/1982 |
| JP | 05-012991 | | 1/1993 |
| JP | 1996-138558 | | 5/1996 |
| JP | 11-86739 | | 3/1999 |
| JP | 1999-265661 | | 9/1999 |
| JP | 2002-170493 | | 6/2002 |
| JP | 2002-216636 | | 8/2002 |
| JP | 2002-289103 | | 10/2002 |
| JP | 2003208851 | A * | 7/2003 |
| JP | 2003-338247 | | 11/2003 |
| JP | 2004-241379 | | 8/2004 |
| KR | 166018 | * | 12/1998 |

OTHER PUBLICATIONS

Notice to Submit Response by Korean Intellectual Property Office on Apr. 26, 2006.

* cited by examiner

*Primary Examiner*—Mariceli Santiago
(74) *Attorney, Agent, or Firm*—Knobbe Martens Olson & Bear LLP

(57) ABSTRACT

A plasma display panel including slanted electrodes is disclosed. In one embodiment, the plasma display panel includes: i) a front substrate, ii) a rear substrate facing the front substrate, iii) a dielectric wall interposed between the front and rear substrates to define discharge cells together with the front and rear substrates, iv) discharge electrodes including first and second discharge electrodes slanted at predetermined angles and embedded in the dielectric wall, wherein the first and second discharge electrodes surround on a diagonal, discharge corners of a discharge cell, respectively, and v) red, green, and blue phosphor layers formed in the discharge cells. Since the discharge electrodes are slanted, degradation of the phosphor layers due to the collision of ions during the discharge can be minimized. Therefore, the lifetime of the panel can be prolonged.

18 Claims, 5 Drawing Sheets

PLASMA DISPLAY PANEL HAVING SLANTED ELECTRODES EMBEDDED IN DIELECTRIC PARTITION WALLS

CROSS-REFERENCE TO RELATED PATENT APPLICATIONS

This application claims the benefit of Korean Patent Application No. 10-2004-0069150, filed on Aug. 31, 2004, in the Korean Intellectual Property Office, the disclosure of which is incorporated herein in its entirety by reference.

BACKGROUND OF THE INVENTION

1. Field of the Invention

The present invention relates to a plasma display panel having slanted discharge electrodes disposed so as to generate discharge in diagonal corners of discharge cells.

2. Description of the Related Technology

In general, plasma display panels (PDPs) are flat panel display devices in which a discharge gas is injected between two substrates so as to generate a discharge. Phosphor layers are excited by ultraviolet radiation generated due to the discharge to display desired numbers, characters, and images.

A conventional three-electrode surface discharge PDP includes a front substrate, a plurality of pairs of sustain electrodes disposed on an inner surface of the front substrate, and a front dielectric layer covering the sustain electrode pairs. The PDP also includes a protective layer coated on the front dielectric layer, a rear substrate facing the front substrate, address electrodes formed on the rear substrate, and a rear dielectric layer covering the address electrodes. The PDP further includes barrier ribs installed between the front substrate and the rear substrate, and red, green, and blue phosphor layers formed on inner surfaces of the barrier ribs.

Each sustain electrode pair generally includes an X electrode and a Y electrode disposed in parallel to the X electrode. The X electrode includes a first transparent electrode line, and a first bus electrode line electrically connected to the first transparent electrode line. The Y electrode includes a second transparent electrode line, and a second bus electrode line electrically connected to the second transparent electrode line. Each Y electrode generally crosses the address electrodes.

In a conventional PDP having the above structure, electrical signals are applied to the Y electrode and the address electrode to select a discharge cell. The electrical signals are alternately applied to the X and Y electrodes and generate a surface discharge along the surface of the front substrate, thereby generating ultraviolet radiation. Then, the red, green, and blue phosphor layers coated in the selected discharge cells emit visible light and display a still image or a moving picture image.

Japanese Laid-open Patent No. 2002-216636 discloses an electrode structure for improving an aperture rate. Japanese Laid-open Patent No. 1999-265661 discloses an electrode structure with an improved aperture rate by reducing the number of sustain discharge electrodes located on the front substrate. Japanese Laid-open Patent No. 1996-138558 discloses an electrode structure with a high level of brightness achieved by increasing an aspect ratio.

However, conventional PDPs such as those described in the above Japanese publications cause the following problems.

The first and second bus electrodes, which are formed of conductive metal, are electrically connected to each other so as to improve the conductivity of the first and second transparent electrode lines. The first and second transparent electrode lines are formed of a transparent conductive material such as indium tin oxide (ITO) so as to reduce line resistance.

Although the first and second bus electrodes have good conductivity, since they are formed of opaque metal, they reduce the aspect ratio of the front substrate. Accordingly, the brightness of the plasma display panel is reduced and the discharge efficiency is lowered.

In addition, i) the sustain discharge electrode pair and ii) the front dielectric layer and iii) the protective layer are sequentially formed on the inner surface of the front substrate so that they block the light transmitting path of the PDP. Thus, the light transmittance is less than 60%. Therefore, the performance of the PDP decreases.

Furthermore, when the PDP is driven for a long time, the discharge is diffused toward the phosphor layer. Due to the electric field, charged particles of the discharge gas cause ion-sputtering of the phosphor layer, resulting in a permanent residual image.

The discharge starts from a discharge gap between the X and Y electrodes and diffuses to edges of the X and Y electrodes, along the plane of the front substrate. Thus, the discharge space is limited.

When a high concentration of Xe gas is used to fill the discharge cell, typically 10% by volume or more, ionization and excitation of the electrons cause the generation of excitons, and thus, the PDP brightness and discharge efficiency may increase. However, if high concentration Xe gas is used, a higher initial discharge firing voltage is required.

SUMMARY OF CERTAIN INVENTIVE ASPECTS

One aspect of the present invention provides a plasma display panel having discharge electrodes, disposed along circumferences of discharge cells so as to improve an aspect ratio of the discharge cells.

Another aspect of the present invention provides a plasma display panel (PDP) having slanted discharge electrodes which surround, on a diagonal discharge corners of each discharge cell. In one embodiment, the electrode structure can minimize damage of a phosphor layer due to a discharge flux during a sustain discharge.

Another aspect of the present invention provides a PDP including: i) a front substrate, ii) a rear substrate facing the front substrate, iii) a dielectric wall interposed between the front and rear substrates so as to define discharge cells together with the front and rear substrates, iv) discharge electrodes including first and second discharge electrodes slanted at a predetermined angle and embedded in the dielectric wall, wherein the discharge electrodes surround, on a diagonal, discharge corners of each discharge cell, and v) red, green, and blue phosphor layers formed in the discharge cells.

In one embodiment, the first and second discharge electrodes may be opposed to each other with respect to a discharge cell and may extend in parallel to each other along an edge of the discharge cell.

In one embodiment, the slant angle ($\alpha$) of the first and second discharge electrodes may satisfy:

$$\text{about } 5° < \alpha < \text{about } 40°,$$

where $\alpha$ is formed by the first or second discharge electrode with respect to a line that is substantially perpendicular to one of the front and rear substrates.

In one embodiment, the first and second discharge electrodes may be slanted toward each other.

In one embodiment, the first and second discharge electrodes may be comb-shaped and disposed cater-cornered with respect to the discharge cell.

In one embodiment, the plasma display panel may further include a barrier rib corresponding to the dielectric wall formed between the dielectric wall and the rear substrate, wherein the phosphor layer is formed on the barrier rib.

BRIEF DESCRIPTION OF THE DRAWINGS

Embodiments of the present invention will be described with reference to the attached drawings.

DETAILED DESCRIPTION OF CERTAIN INVENTIVE EMBODIMENTS

Figure 1:
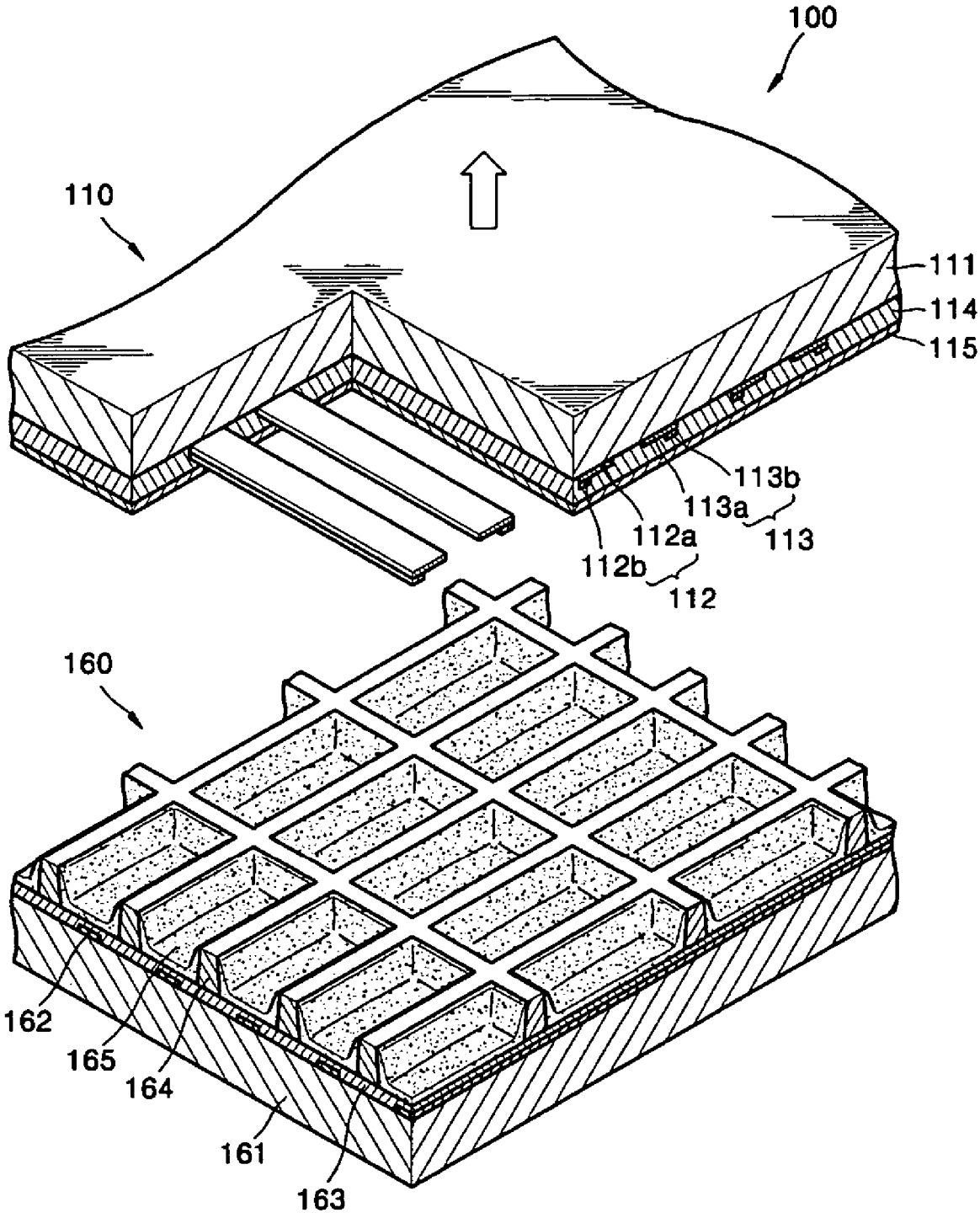
FIG. 1 (PRIOR ART)
FIG. 1 is an exploded perspective view of a conventional plasma display panel.

FIG. 1 is an exploded perspective view of a plasma display panel 100 according to the conventional art.

Referring to FIG. 1, the plasma display panel 100 includes a front panel 110 and a rear panel 160.

The front panel 110 includes a front substrate 111, an X electrode 112 and a Y electrode 113 formed on an inner surface of the front substrate 111, a front dielectric layer 114 covering the X and Y electrodes 112 and 113, and a protective layer 115 coated on the front dielectric layer 114. The X electrode 112 includes a first transparent electrode 112*a*, and a first bus electrode 112*b* electrically connected to the electrode 112*a*. The Y electrode 113 includes a second transparent electrode 113*a*, and a second bus electrode 113*b* electrically connected to the electrode 113*a*.

The rear panel 160 includes a rear substrate 161 facing the front substrate 111, an address electrode 162 formed on an inner surface of the rear substrate 161, and a rear dielectric layer 163 covering the address electrode 162. The address electrode 162 is disposed perpendicularly to the X and Y electrodes 112 and 113.

Barrier ribs 164, defining discharge cells and preventing cross talk between discharge cells, are formed between the front and rear panels 110 and 160. In addition, a red, green, or blue phosphor layer 165 is formed in each of the discharge cells inside of the barrier ribs 164.

In order to drive the plasma display panel 100, electric signals are applied to the Y electrode 113 and the address electrode 162 so as to select a discharge cell. Once a discharge cell is selected, an electric signal is alternately applied to the X and Y electrodes 112 and 113 to generate a surface discharge at the surface of the front substrate 111. Ultraviolet radiation is then generated, and visible light is emitted from the red, green, or blue phosphor layer 165 coated in the selected discharge cell and display a still image or a moving picture image.

Figure 2:
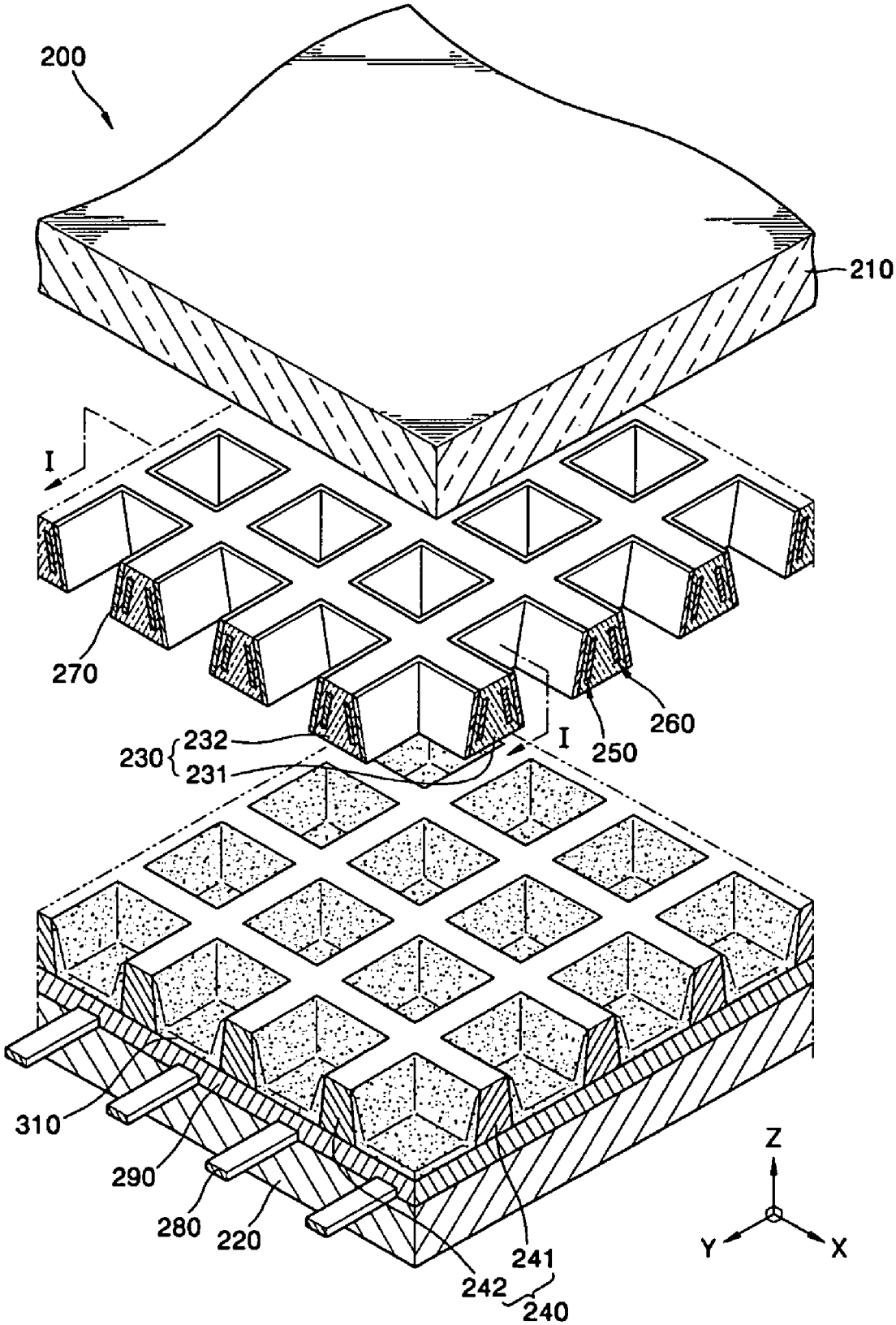
FIG. 2 is an exploded perspective view of a part of the plasma display panel according to an embodiment of the present invention.

FIG. 2 is an exploded perspective view of a plasma display panel 200 according to an embodiment of the present invention.

Referring to FIG. 2, the plasma display panel 200 includes a front substrate 210 and a rear substrate 220 disposed in parallel to the front substrate 210. In one embodiment, a frit glass is formed on edges of the surfaces of the front and rear substrates 210 and 220 so as to couple the substrates 210 and 220 and seal the inner space of the PDP.

In one embodiment, the front substrate 210 can be formed of a transparent substrate material, for example, soda lime glass, and the rear substrate 220 can be formed of the same material as the front substrate 210.

Dielectric walls 230 defining discharge cells are disposed between the front and rear substrates 210 and 220. In one embodiment, the dielectric walls 230 are formed by adding various fillers to a glass paste.

The dielectric walls 230 include a first dielectric wall 231 extending in an X direction, and a second dielectric wall 232 extending in a Y direction (see FIG. 2). In one embodiment, the first dielectric wall 231 crosses the second dielectric wall 232 and form a matrix pattern. In this embodiment, each discharge cell has a square cross section.

In another embodiment, the dielectric wall 230 can be formed in a meander pattern, a delta pattern, a hexagon pattern, or a honeycomb pattern. In one embodiment, the discharge cells defined by the dielectric walls 230 can be formed in other polygonal shapes or in a circular shape.

Barrier ribs 240 can be further formed between the dielectric walls 230 and the rear substrate 220. In one embodiment, the barrier ribs 240 are formed of a low dielectric material unlike the dielectric walls 230. The barrier ribs 240 are generally formed on the dielectric walls 230 in the same shape as the dielectric walls 230.

The barrier ribs 240 include a first barrier rib 241 disposed in parallel to the first dielectric wall 231, and a second barrier rib 242 disposed in parallel to the second dielectric wall 232. In one embodiment, as shown in FIG. 2, the first and second barrier ribs 241 and 242 are integrally coupled to each other to form a matrix.

In one embodiment (not shown), if the dielectric walls 230 are formed between the front and rear substrates 210 and 220, a single layer wall defines the discharge cells. In another embodiment, if the dielectric walls 230 and the barrier ribs 240 are formed between the front and rear substrates 210 and 220, double layer walls, formed of materials having different dielectric properties, define the discharge cells as shown in FIG. 2.

A first discharge electrode 250 and a second discharge electrode 260 are embedded in the first dielectric wall 231. The discharge electrodes 250 and 260 are disposed along the perimeter of the discharge cell, not in the discharge cell, and thus they do not block the light transmitting path of the PDP. The electrodes 250 and 260 are electrically insulated from each other, and different voltages are applied thereto. Third and fourth discharge electrodes are embedded in the second dielectric wall 232 as shown in FIG. 2. FIG. 2 shows a plurality of second dielectric walls which include and are substantially parallel with the dielectric wall 232. Each second dielectric wall covers third and fourth discharge electrodes and is arranged to cross each first dielectric wall.

A protective layer 270, typically an MgO layer, is formed on an inner surface of the dielectric walls 230 so that ions generated in the front substrate 210 along side walls of the discharge cell can emit secondary electrons through an interaction with the surface of the dielectric walls 230. The protective layer 270 is deposited in all of the discharge cells.

In one embodiment, an address electrode 280 is disposed on the rear substrate 220 perpendicular to the first and second discharge electrodes 250 and 260. In this embodiment, the address electrode 280 is located below the discharge cells, and is covered under the rear dielectric layer 290.

In one embodiment, the plasma display panel 200 can include only the first and second discharge electrodes 250 and 260. In another embodiment, the panel 200 can include i) the first and second discharge electrodes 250 and 260, and ii) the address electrode 280, according to discharge type such as surface discharge or opposing discharge. In one embodiment, each of the electrodes can be a single electrode or plural electrodes.

In the illustrated embodiment, the first and second discharge electrodes 250 and 260 cause the sustain discharge. The first discharge electrode 250 corresponds to an X electrode (that is, a sustain discharge electrode), and the second discharge electrode 260 corresponds to a Y electrode (that is, a scan electrode). In addition, the address electrode 280 causes an address discharge in combination with the Y electrode 260. In one embodiment, the address electrode 280 can be disposed in the dielectric walls 230 where the first and second discharge electrodes 250 and 260 are embedded.

In addition, a discharge gas such as Ne—Xe or He—Xe is injected into the discharge cells defined by the front and rear substrates 210 and 220, the dielectric wall 230, and the barrier rib 240.

Red, green, and blue phosphor layers 310 are excited by ultraviolet radiation generated by the discharge gas and emit visible light. In one embodiment, each phosphor layer 310 can be coated on any region in the discharge cell. In another embodiment, the phosphor layer 310 is coated at a predetermined thickness on inner surfaces of the barrier rib 240 and the upper surface of the rear dielectric layer 290.

The red, green, or blue phosphor layer 310 is coated in each discharge cell. In one embodiment, the red phosphor layer can be formed of $(Y,Gd)BO_3:Eu^{+3}$, the green phosphor layer can be formed of $Zn_2SiO_4:Mn^{2+}$, and the blue phosphor layer can be formed of $BaMgAl_{10}O_{17}:Eu^{2+}$.

Here, the first discharge electrode 250 and the second discharge electrode 260 are disposed so as to surround discharge corners of the discharge cell on a diagonal with respect to each other. In one embodiment, the electrodes 250 and 260 are slanted at predetermined angles toward each other with respect to walls of the discharge cell.

Figure 3:
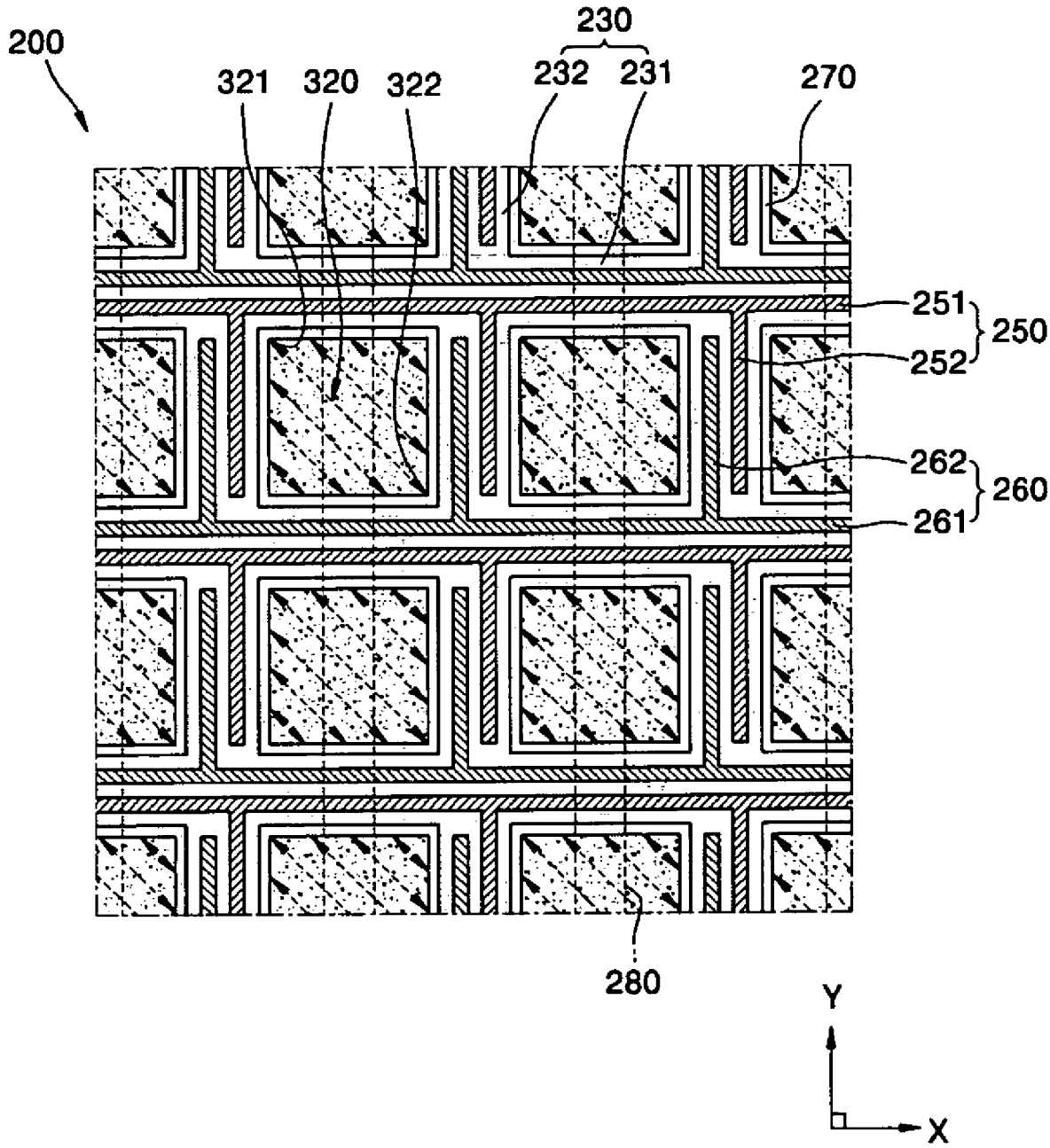
FIG. 3 is a plan view of arrangement of discharge electrodes in FIG. 2.
Figure 4:
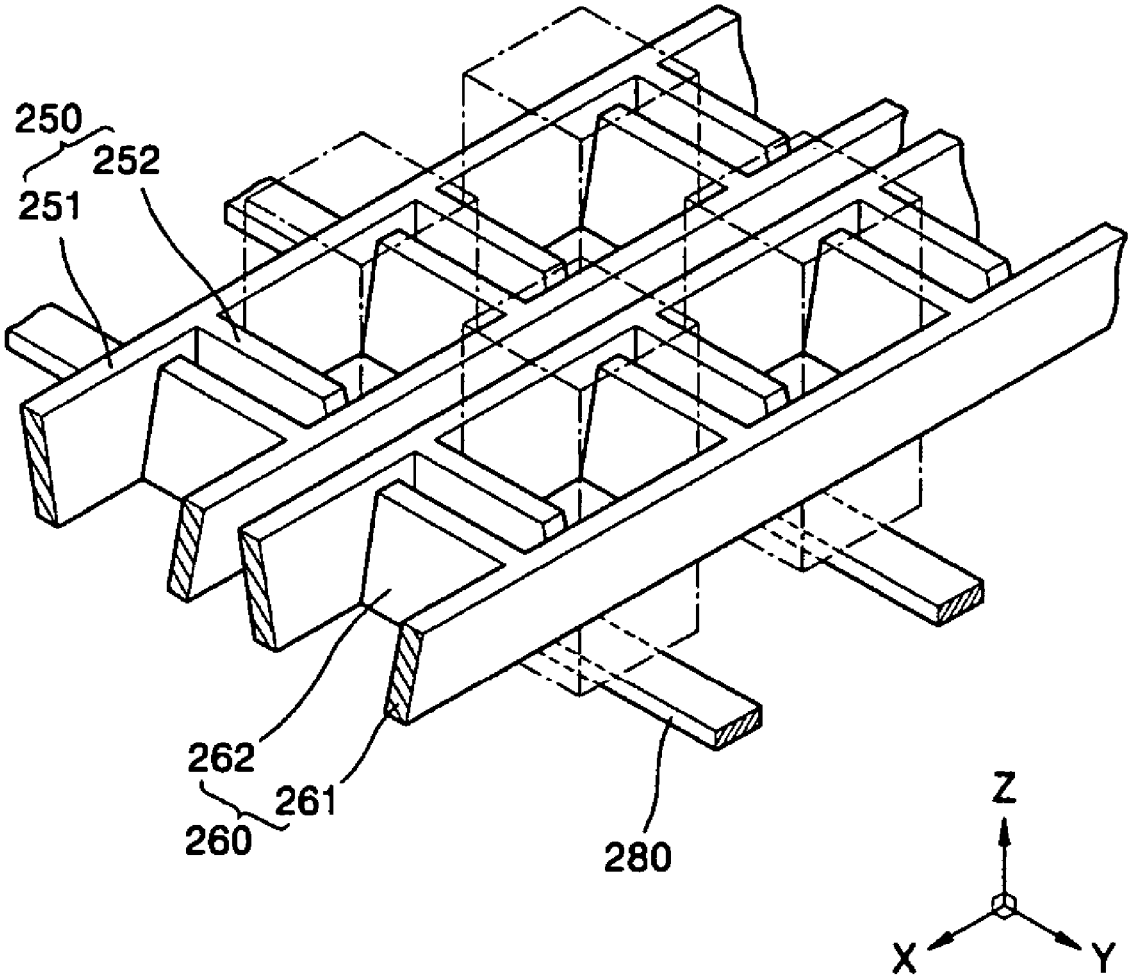
FIG. 4 is an exploded perspective view of the discharge electrodes in FIG. 2.

FIG. 3 is a plan view of the electrodes shown in FIG. 2, and FIG. 4 is a perspective view of the electrodes shown in FIG. 3.

Referring to FIGS. 3 and 4, the plasma display panel 200 includes the first dielectric wall 231 extending in the X direction, and the second dielectric wall 232 extending substantially perpendicular to the first dielectric walls 231 in the Y direction. The discharge cell 320 defined by the first and second dielectric walls 231 and 232 has a square cross section. The discharge cells 320 are consecutively disposed in an array along the X and Y directions as shown in FIG. 3.

The first discharge electrode 250 is embedded in the dielectric wall 230. The first discharge electrode 250 surrounds a first discharge corner 321 of the discharge cell 320. The second discharge electrode 260 is also embedded in the dielectric wall 230. The second discharge electrode 260 surrounds a second discharge corner 322 of the discharge cell 320, wherein the second discharge corner 322 is located on a diagonal with respect to the first discharge corner 321. In this embodiment, the address electrode 280 passes center portions of the discharge cells 320 and extends in the Y direction.

The first discharge electrode 250 includes a first discharge electrode line 251 extending along the X direction. In one embodiment, the first discharge electrode line 251 is formed as a strip. In one embodiment, one first discharge electrode line 251 is disposed in each first dielectric wall 231.

A first protrusion 252 extends from the first discharge electrode line 251 in the Y direction. The length of the first protrusion 252 corresponds to the length of the side of the discharge cell 320 extending in the Y direction. The first protrusion 252 is disposed in each of the second dielectric walls 242.

The first discharge electrode line 251 surrounds the first discharge corner 321 together with the first protrusion 252. In one embodiment, the first protrusion 252 is formed integrally from the line 251. In addition, the first discharge electrode line 251 and the first protrusion 252 are coupled to each other and form a comb shape.

The second discharge electrode 260 includes a second discharge electrode line 261 extending in parallel to the first discharge electrode line 251.

The second discharge electrode line 261 is paired with the first discharge electrode line 251 in the discharge cell 320 and generate the sustain discharge. The second discharge electrode line 261 is located at the opposing side of the first discharge electrode line 251 as shown in FIG. 3.

In one embodiment, the second discharge electrode line 261 is formed as a strip. In one embodiment, one second discharge electrode line 261 is disposed in each first dielectric wall 231.

In one embodiment, a second protrusion 262 is integrally connected to the second discharge electrode line 261 and extends in the Y direction. The length of the second protrusion 262 corresponds to the length of the side of discharge cell 320 extending in the Y direction. At least one second protrusion 262 is disposed in each of the second dielectric walls 232.

The second discharge electrode line 261 surrounds the second discharge corner 322 together with the second protrusion 262. In one embodiment, the second protrusion 262 extends integrally from the second discharge electrode line 261.

In one embodiment, the second discharge electrode line 261 and the second protrusion 262 are coupled to form a comb shape. In this embodiment, the first and second protrusions 252 and 262 are alternately disposed.

In one embodiment, the first discharge electrode 250 can surround both discharge corners on one side of the discharge cell 320, and the second discharge electrode 260 can surround both discharge corners on the other side of the discharge cell 320. That is, the first and second discharge electrodes are not limited to a certain structure as long as the discharge can occur in the diagonal direction in the discharge cell 320.

In one embodiment, the address electrode 280 is formed as a strip. The address electrode 280 is substantially perpendicular to the second discharge electrode line 261, and extends in the Y direction. The address electrode 280 extends below the center portions of the discharge cells 320 that are arranged in the Y direction.

In the present embodiment, although the address electrode 280 is disposed on the rear substrate 220 (refer to FIG. 2), it can be embedded in the dielectric walls 230 as long as the dielectric walls 230 cross the second discharge electrode 260.

Meanwhile, since the first and second discharge electrodes 250 and 260 are disposed along the perimeter of the discharge cell 320, not in the discharge cell 320, they do not affect the aperture rate of the substrate. Therefore, the first and second discharge electrodes 250 and 260 can be formed of a non-transparent material, for example, a conductive material such as a silver (Ag) paste or Cr—Cu—Cr.

Figure 5:
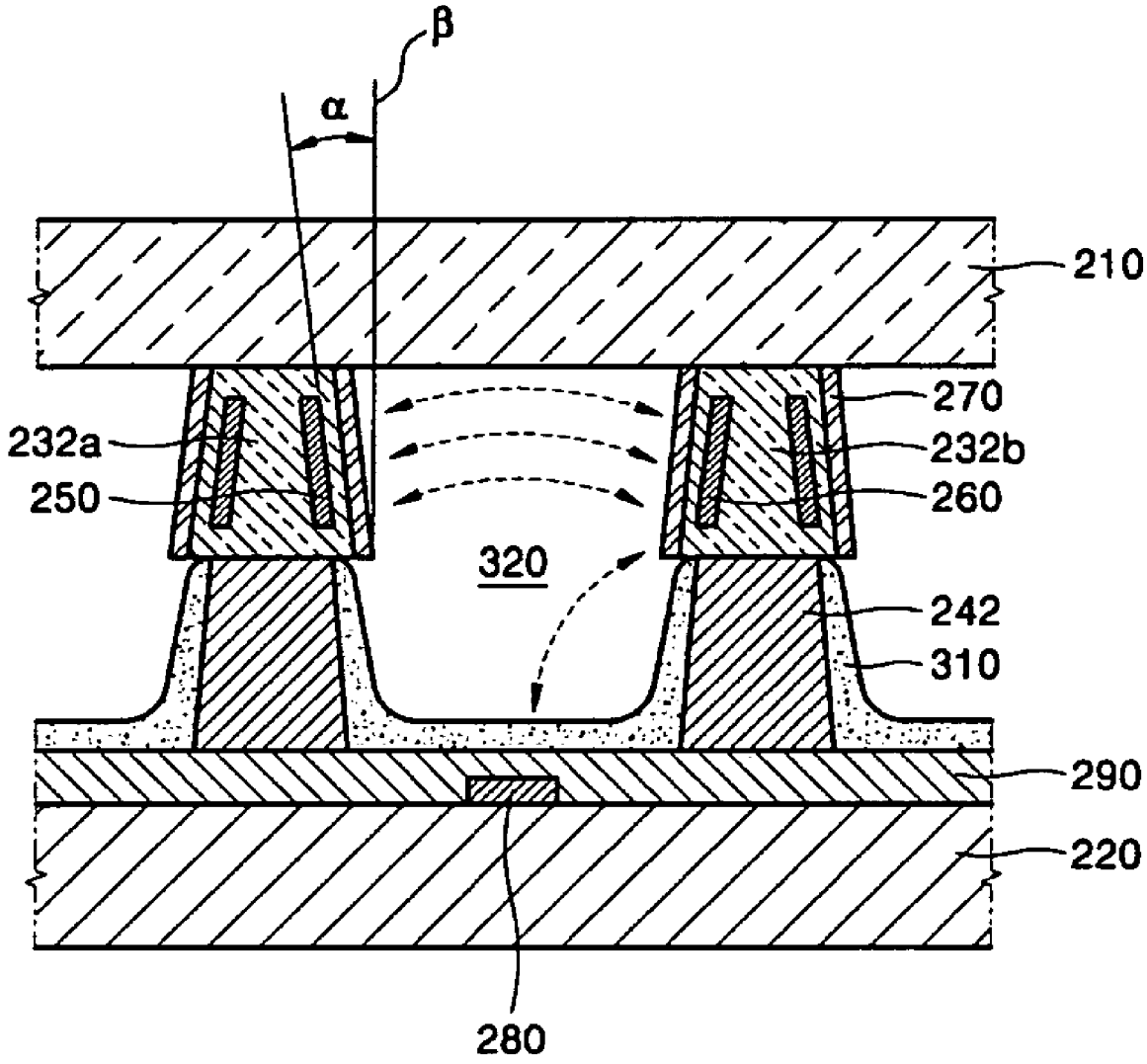
FIG. 5 is a cross-sectional view of the plasma display panel taken along line I-I of FIG. 2 when the panels are coupled to each other.

FIG. 5 is a cross-sectional view of the plasma display panel 200 of FIG. 2 taken along line I-I.

Referring to FIG. 5, the tops of the first and second discharge electrodes 250 and 260 are slanted away from the adjacent discharge cell 320. Thus, the tops of the electrodes 250 and 260 embedded together in the same wall are slanted toward each other as shown in FIG. 5.

In one embodiment, the slant angle (a) satisfies the following relationship:

about 5°<α<about 40°.

Here, it is assumed that a virtual line substantially perpendicular to one of the front and rear substrates 210 and 220 is β, and α is formed by i) the virtual line β and ii) the first or second discharge electrode 250 or 260.

If α is less than about 5°, the degree of slant of the first or second discharge electrode 250 or 260 is small, and the red, green, or blue phosphor layer 310 may be damaged due to the motion of the ions during the discharge. In contrast, if α is greater than about 40°, the first and second discharge electrodes 250 and 260 disposed in the same first or second dielectric wall 231 or 232 and contributing to the discharge in different discharge cells 320 may interrupt each other.

In one embodiment, the dielectric wall 230 is slanted at the same angle as the first and second discharge electrodes 250 and 260. Accordingly, the slanted protective layer 270 is deposited on the slanted surface of the dielectric wall 230 as shown in FIG. 5.

In one embodiment, the first and second discharge electrodes 250 and 260 can be formed in other shapes besides the strip shape as long as the surfaces of the first and second discharge electrodes 250 and 260 are slanted.

Experimental results of maintaining brightness for a fixed period of time with various embodiments are shown in table 1.

TABLE 1

| | Angle | Full white | Full red | Full green | Full blue |
|---|---|---|---|---|---|
| Comparative example | 0° | 87% | 86% | 82% | 75% |
| Embodiment 1 | 10° | 90% | 89% | 85% | 79% |
| Embodiment 2 | 20° | 92% | 91% | 87% | 81% |
| Embodiment 3 | 30° | 94% | 94% | 90% | 82% |

Table 1 shows the relative brightness when operating continuously for 500 hours assuming an initial brightness 100%. In addition, in the comparative example, the discharge electrode was not slanted (i.e., α=0°), and the slanted degrees of the discharge electrodes in the first through third embodiments of the present invention were 10°, 20°, and 30°, respectively.

In the comparative example, the relative brightness for white light was 87%, and the relative brightnesses for the red, green, and blue colors were 86%, 82%, and 75%, respectively. In the first embodiment, the relative brightnesses for white, red, green, and blue colors were 90%, 89%, 85%, and 79%, respectively. In the second embodiment, the relative brightnesses 92%, 91%, 87%, and 81%, respectively. In the third embodiment, those numbers were 94%, 94%, 90%, and 82%, respectively.

As seen from the table, the relative brightness increased when the slanted angle increased.

The operation of the plasma display panel 200 will be described with reference to FIGS. 3 through 5.

When a predetermined pulse voltage is applied between the second discharge electrode 260 and the address electrode 280 from an external power source, a discharge cell 320 to emit light is selected. The wall charges accumulate in the selected discharge cell 320.

When a positive voltage is applied to the first electrode 250 and a relatively higher voltage is applied to the second electrode 260, the wall charges move due to the voltage difference.

Next, when the wall charges move, the wall charges collide with discharge gas atoms in the discharge cell 320 and generate plasma. The discharge starts from the first and second discharge corners 321 and 322 where the stronger electric field is formed and is diffused to the center portion of the discharge cell 320.

After generating the discharge, when the voltage difference between the first and second electrodes 250 and 260 becomes less than the discharge voltage, the discharge does not occur any more, and space charges and wall charges are formed in the discharge cell 320. Here, if the polarities of voltages applied to the first and second electrodes 250 and 260 change into the opposite one, respectively, the discharge occurs again with the help of the wall charges, and the initial discharge process is repeated. Through the above repeated processes, the discharge is generated in a stable way.

The plasma display panel according to embodiments of the present invention will generally provide the following effects.

Since none of i) the discharge electrodes, ii) the dielectric layer, and iii) the protective layer block the light transmitting path of the PDP, the aperture rate is not affected. Therefore, the PDP brightness can be greatly enhanced.

In addition, the discharge can occur along the side surfaces of the discharge cell, and thus, the discharge space significantly increases.

Since the discharge starts from the discharge corners of the discharge cell and is diffused toward the center portion of the discharge cell, the discharge efficiency can be enhanced. Also, since the path of ion particles during the sustain discharge is formed horizontally in the phosphor layer, the ion sputtering of the phosphor layer can be prevented, and the lifetime of the PDP can be prolonged.

Furthermore, since the discharge electrodes are slanted in the diagonal direction of the discharge cell, the degradation of the phosphor layer due to the collision of ions can be minimized. Therefore, the lifetime of the PDP can be prolonged.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A plasma display panel, comprising:

a front substrate configured to display an image;

a rear substrate facing the front substrate;

a dielectric wall interposed between the front and rear substrates so as to define discharge cells together with the front and rear substrates, wherein the dielectric wall has top and bottom surfaces opposing each other, wherein the top surface faces the front substrate, and wherein the dielectric wall becomes gradually thinner from the bottom surface to the top surface;

a plurality of discharge electrodes each including first and second discharge electrodes, and embedded in the dielectric wall, wherein the first and second discharge electrodes surround, on a diagonal, discharge corners of each discharge cell, respectively, wherein at least one of the first and second discharge electrodes is slanted at a predetermined angle (α) with respect to the perpendicular to at least one of the front and rear substrates, and wherein tops of the first and second discharge electrodes embedded in the same dielectric wall are slanted toward each other; and a plurality of types of phosphor layers formed in the discharge cells.

2. The plasma display panel of claim 1, wherein the first discharge electrode and the second discharge electrode are opposing each other, and wherein each of the first and second electrodes is comb-shaped.

3. The plasma display panel of claim 1, wherein the predetermined angle ($\alpha$) satisfies the following relationship:

$$\text{about } 5° < \alpha < \text{about } 40°.$$

4. The plasma display panel of claim 1, wherein the first discharge electrode includes a first discharge electrode line, and a first protrusion extending from the first discharge electrode line in a direction so as to surround a first discharge corner of a discharge cell together with the first discharge electrode line.

5. The plasma display panel of claim 1, wherein the second discharge electrode includes a second discharge electrode line, and a second protrusion extending from the second discharge electrode line in a direction so as to surround a second discharge corner of a discharge cell together with the second discharge electrode line.

6. The plasma display panel of claim 1, wherein the slant angles for the first and second discharge electrodes are the same.

7. The plasma display panel of claim 1, further comprising an address electrode that generates an address discharge in combination with one of the first and second discharge electrodes.

8. The plasma display panel of claim 7, wherein the address electrode is formed over the rear substrate.

9. The plasma display panel of claim 1, further comprising a barrier rib corresponding to the dielectric wall formed between the dielectric wall and the rear substrate, wherein each of the phosphor layers is formed on the barrier rib.

10. The plasma display panel of claim 1, further comprising a protective layer formed only on surfaces of the dielectric wall.

11. The plasma display panel of claim 7, wherein the address electrode is embedded in the dielectric wall.

12. The plasma display panel of claim 9, wherein the barrier rib has a slanted surface.

13. A plasma display panel, comprising:

a dielectric wall located between first and second substrates, opposing each other, so as to define discharge cells together with the substrates, wherein the first substrate is configured to display an image, wherein the dielectric wall has top and bottom surfaces opposing each other, wherein the top surface faces the first substrate, and wherein the dielectric wall becomes gradually thinner from the bottom surface to the top surface; and first and second discharge electrodes embedded in the dielectric wall and surrounding, on a diagonal, discharge corners of a discharge cell, wherein at least one of the first and second discharge electrodes is slanted at a predetermined angle ($\alpha$) with respect to the perpendicular to one of the substrates, and wherein tops of the first and second discharge electrodes embedded in the same dielectric wall are slanted toward each other.

14. The plasma display panel of claim 13, wherein the predetermined angle ($\alpha$) satisfies the following relationship:

$$\text{about } 5° < \alpha < \text{about } 40°.$$

15. The plasma display panel of claim 13, further comprising a protective layer formed only on surfaces of the dielectric wall.

16. A structure for a plasma display panel, the structure comprising:

a plurality of first dielectric walls each covering first and second discharge electrodes; and a plurality of second dielectric walls each covering third and fourth discharge electrodes and arranged to cross the plurality of first dielectric walls, respectively, wherein tops of the first and second discharge electrodes embedded in the same dielectric wall are slanted toward each other, and wherein tops of the third and fourth discharge electrodes embedded in the same dielectric wall are slanted toward each other.

17. The structure of claim 16, wherein the tops of the first and second discharge electrodes face a substrate which is configured to display an image.

18. A plasma display panel, comprising:

a dielectric wall located between first and second substrates, opposing each other, so as to define discharge cells together with the substrates, wherein the first substrate is configured to display an image, wherein the dielectric wall has top and bottom surfaces opposing each other, wherein the top surface faces the first substrate, and wherein the dielectric wall becomes gradually thinner from the bottom surface to the top surface;

first and second discharge electrodes embedded in the dielectric wall and surrounding, on a diagonal, discharge corners of a discharge cell, wherein the first and second discharge electrodes are not parallel to each other; and a protective layer formed only on surfaces of the dielectric wall.

* * * * *